United States Patent [19]

Dougherty

[11] 3,972,510

[45] Aug. 3, 1976

[54] MULTI-BLADED UPRIGHT FOR A FENCE

[76] Inventor: Duayne D. Dougherty, 6807 N. 39th Ave., Phoenix, Ariz. 85019

[22] Filed: June 24, 1974

[21] Appl. No.: 482,647

[52] U.S. Cl. ..... 256/11; 52/101

[51] Int. Cl.[2] ..... E04H 17/14

[58] Field of Search ..... 256/11, 12, 1; 52/101

[56] References Cited

UNITED STATES PATENTS

| | | | |
|---|---|---|---|
| 814,984 | 3/1906 | Palmer | 256/11 |
| 2,306,080 | 12/1942 | Peles | 256/11 X |
| 3,407,550 | 10/1968 | Shaw | 52/101 |
| 3,806,095 | 4/1974 | Ford | 256/11 |

FOREIGN PATENTS OR APPLICATIONS

| | | | |
|---|---|---|---|
| 169,872 | 4/1906 | Germany | 256/11 |

*Primary Examiner*—Dennis L. Taylor

*Attorney, Agent, or Firm*—Herbert E. Haynes, Jr.

[57] ABSTRACT

A plurality of metallic tubular uprights incrementally spaced along the top of a fence or similar structure, are each provided with a plurality of upwardly outwardly flared knife-edge segments to prevent climbing of the fence.

1 Claim, 18 Drawing Figures

MULTI-BLADED UPRIGHT FOR A FENCE

BACKGROUND OF THE INVENTION

1. Field of the Invention

This invention relates to the fence art and more particularly to upright structures atop a fence to prevent climbing of the fence.

2. Description of the Prior Art

Fenced areas requiring more security than can be provided by an ordinary fence have traditionally employed multiple strands of barbed wire strung along the fence top to serve as a deterrent to anyone trying to gain entry to the property by climbing over the fence.

It is well known that barbed wire will not stop anyone who is determined to climb over a fence, as it is a simple matter to cut the barbed wire with a pair of pliers, wire cutters or similar tool. Further, the inherent unsightliness of barbed wire has resulted in its being employed almost solely in commercial areas where appearance is not an important factor. Barbed wire is seldom used on front fences of business establishments or other commercial property where appearance is an important factor, and is rarely employed to protect residential property.

Recently, a new product was developed to replace barbed wire, and this new product is sometimes referred to as Ribbon Wire. Briefly, Ribbon Wire is a very thin razor sharp elongated strand of metal which is strung on fence tops in a manner to barbed wire. Like barbed wire, Ribbon Wire is unsightly and can be easily cut with commonplace tools. Also, Ribbon Wire is very dangerous in that simply touching it can result in a serious cut, and should the Ribbon Wire break or be intentionally cut, it can seriously hurt anyone near it due to a whipping action which often follows.

Therefore, a need exists for a new and useful product for use on fence tops which overcomes some of the problems and shortcomings of the prior art.

SUMMARY OF THE INVENTION

In accordance with the present invention, a multi-bladed upright is disclosed for use on the top of a fence. The multi-bladed upright is formed of an elongated metallic body which is axially cut at the top to form a plurality of segments, and the segments are flared outwardly to provide the upright with a plurality of angularly radially extending knife-edge elements.

A plurality of such multi-bladed uprights suitably mounted in spaced increments along the top of a fence will provide a relatively attractive means for preventing climbing of the fence and which cannot be easily cut or otherwise removed.

Accordingly, it is an object of the present invention to provide a new and useful multi-bladed upright for use on the top of a fence.

Another object of the present invention is to provide a new and useful multi-bladed upright and means for mounting thereof on the top of a fence to prevent climbing of the fence.

Another object of the present invention is to provide a new and useful multi-bladed upright for use on the top of a fence, said upright formed of a metallic body having outwardly flared knife-edge segments at the top thereof.

Another object of the present invention is to provide a new and useful multi-bladed upright of the above described character which when a plurality thereof are mounted in spaced increments along the top of a fence will provide a relatively attractive means for preventing climbing of the fence with such means being difficult to remove.

The foregoing and other objects of the present invention, as well as the invention itself, will be more readily apparent from the following description when read in conjunction with the accompanying drawings.

DESCRIPTION OF THE PREFERRED EMBODIMENTS

Figure 1:
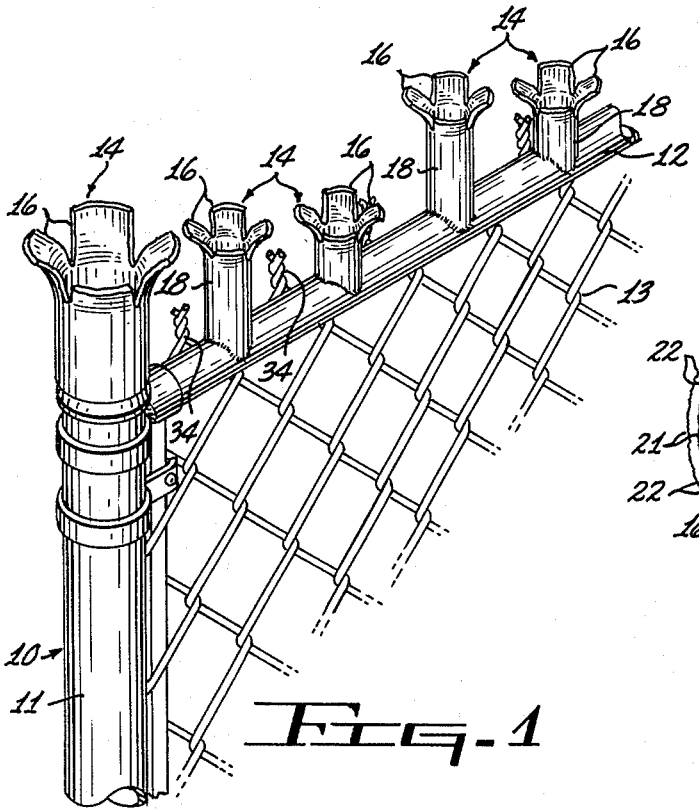
FIG. 1 is a fragmentary isometric view of one type of fence structure having a plurality of the multi-bladed uprights of the present invention mounted thereon.

Referring more particularly to the drawings, FIG. 1 illustrates a fence structure 10 of the type sometimes referred to as a chain link fence, and which includes the usual fence post 11, top rail 12, and linked wire panel 13.

A plurality of multi-bladed uprights 14 of the present invention are mounted in spaced increments along the length of the top rail 12 of the fence 10. Each of the uprights 14 are shown as being welded to the top rail, however, as will hereinafter be described in detail, other means for mounting the uprights 14 can be employed as desired and as dictated by the type of fence upon which the uprights are used.

Figure 2:
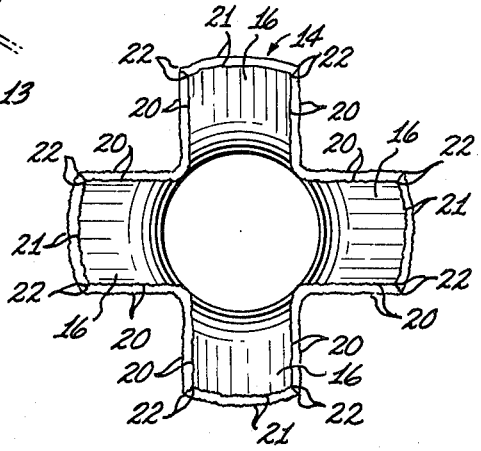
FIG. 2 is an enlarged plan view of the multi-bladed upright of the present invention.
Figure 3:
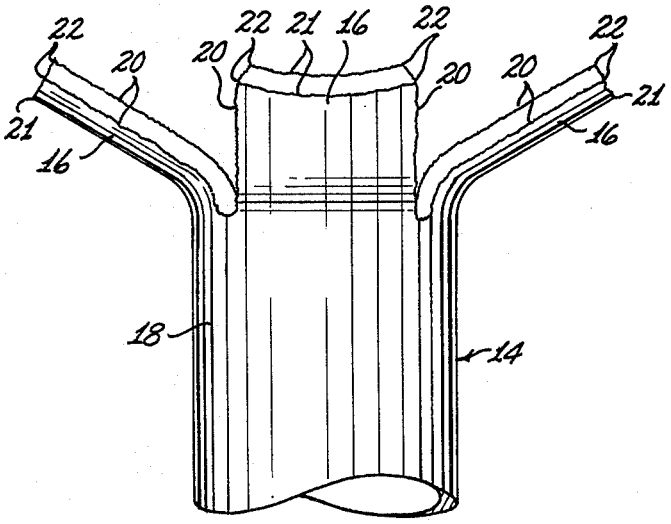
FIG. 3 is a fragmentary elevational view of the multi-bladed upright of the present invention.

In this embodiment of the present invention, the uprights 14 are fabricated of circular metallic tubing such as galvanized pipe which is the material of which chain link fences 10 are usually fabricated. As seen best in FIGS. 2 and 3, the upright 14 is axially cut at the upper end thereof, that is, the upright is cut longitudinally from the top to provide four substantially equally sized segments 16 with the remaining uncut portion of the upright forming a body member 18. Cutting of the upright 14 can be accomplished in any well known manner such as with a power saw, and it is preferred that the upright be cut in four places to form four segments. However, the number of cuts and the number of resulting segments can be varied as desired.

The segments 16 of the upright 14 are flared outwardly for positioning thereof in radially angularly upwardly disposed relationship with respect to the body 18. In this manner, each of the outwardly flared segments 16 will expose two edges 20 on each of its opposite sides, two edges 21 on its top side, and two points 22 at each of the locations where the respective opposite sides meet the top. Thus, each segment will provide a total of six edges and four points with these edges and points being very sharp. It is well known that when metal is cut such as with a power saw, the cut edge is sharp and burrs results and that the burrs themselves are sharp.

As hereinbefore mentioned, a plurality of multi-bladed uprights 14 are mounted in spaced increments along the top of the fence 10. The increments are selected so that the outwardly flared segments 16 of adjacent uprights are in relatively close proximity to each other so that anyone trying to climb over the fence cannot pass their hands and arms between the uprights 14 without coming into engagement with one or more of the knife edges and points of the segments.

FIG. 1 also shows a multi-bladed upright 14 as being suitably affixed to the upper end of the fence post 11 of the fence 10. This post mounted upright 14 is fabricated in the identical manner as the previously described top rail mounted uprights 14, and may be formed of the same diameter pipe that is employed in fabrication of the fence post 11.

Figure 4:
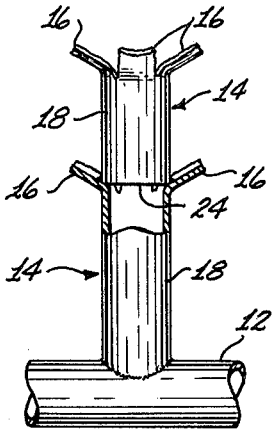
FIG. 4 is an elevational view of a modified form of the multi-bladed upright of the present invention.

FIG. 4 shows an installation technique which can be employed in instances which require added height of the uprights. In this installation the top rail 12 of the fence 10 is provided with an axially aligned pair of uprights 14 suitably affixed such as by welding so that the base 24 of the upper upright 14 is nestingly affixed between the outwardly flared segments 16 of the lower upright 14.

Figure 5:
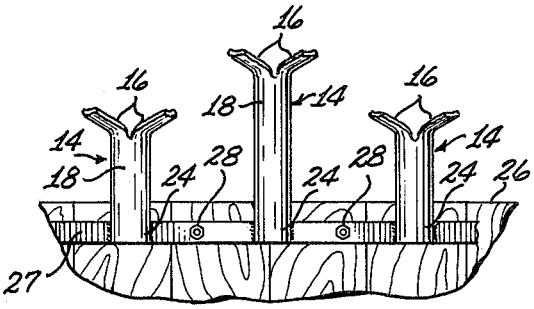
FIG. 5 is a fragmentary elevational view of another type of fence structure which illustrates a method of mounting the multi-bladed upright of the present invention on that type of fence structure.

FIG. 5 illustrates a mounting technique which can be employed on other types of fences or walls such as a masonry (not shown) or a wooden fence 26. On fences or walls of this type which do not employ a top rail, as did the previously described chain link fence 10, a plurality of uprights 14 are suitably affixed such as by welding to a metal strap 27. The strap 27 is attached to each of the spaced uprights 14 adjacent the bases 24 thereof and the strap is affixed to the fence 26 in a suitable manner such as with carriage bolts 28.

Figure 6:
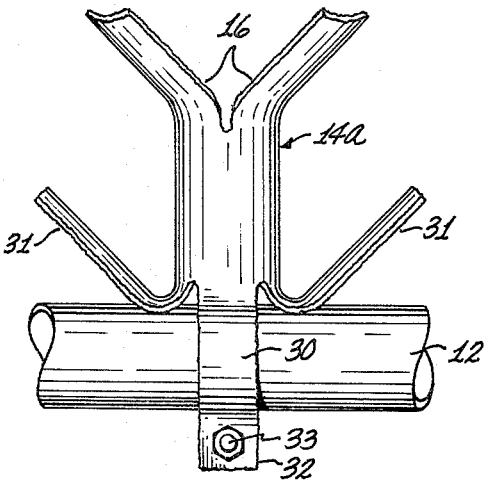
FIG. 6 is a front elevational view of a modified form of the multi-bladed upright of the present invention which also illustrates means thereon for mounting to a fence structure.
Figure 7:
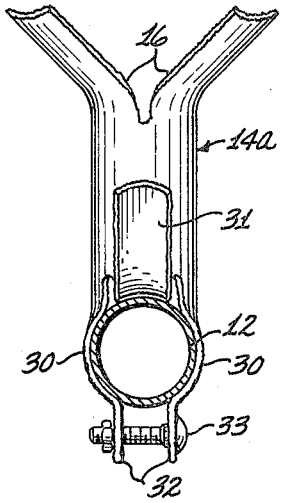
FIG. 7 is a side elevation of the structure shown in FIG. 6.

FIGS. 6 and 7 show an alternate manner of affixing the multi-bladed uprights to the top rail 12 of the fence 10. In this embodiment of the present invention, an upright **14*a* is provided with the outwardly flared segments 16 at the top thereof as previously described, and is axially cut at the lower end of the body 18 in the same manner as employed in the formation of the segments 16 to provide a first pair of diametrically opposed segments 30 and a second pair of diametrically opposed segments 31. The first pair of lower segments 30 are shaped to straddle the top rail 12 of the fence and are each formed with a depending tab portion 32 on their lower ends through which a suitable carriage bolt 33 is passed so that these segments 30 serve to clamp the upright 14*a* to the top rail. The second pair of segments 31 are bent in opposite directions with respect to each other through an arc of more than 90° so as to position these segments in outwardly upwardly angularly extending directions with respect to the body 18 of the upright 14** *a*. Thus, the multi-bladed upright **14*a* is demountably affixed to the top rail 12 of the fence and is provided with two knife edged segments 31 at the lower end of the body 18 in addition to the upper segments 16.**

Figure 8:
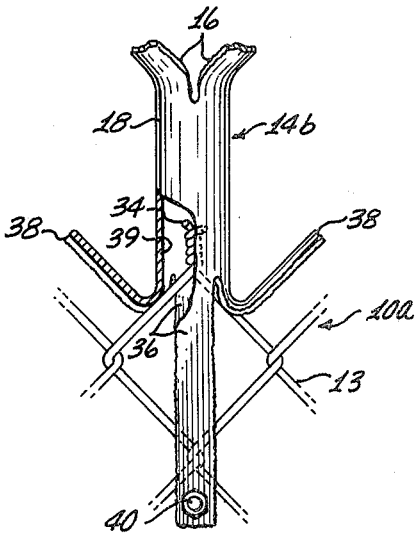
FIG. 8 is a view similar to FIG. 6 which illustrates another means for mounting that form of the multi-bladed upright.

As is well known in the art, some chain link fences do not employ a top rail but simply string the linked wire panel 13 between the fence posts. Thus, a plurality of twisted wire ends 34, FIGS. 1 and 8, will protrude upwardly from the panel 13 at spaced increments along the top thereof. FIG. 8 shows a modified form of the multi-bladed upright of the present invention, which is indicated generally by the reference numeral **14*b* and is suitable for mounting on a chain link fence 10*a* of the type having no top rail. The upright 14*b* is provided with the upper outwardly flared segments 16 as previously described and is cut at the lower end of the body 18 to form a first pair of diametrically opposed lower segments 36 and a second pair of diametrically opposed lower segments 38. The body portion 18 of the upright 14*b* is positioned on the fence 10*a* so that the twisted wire end 34 is disposed within the bore 39 of the body 18. The first pair of lower segments 36 are thus positioned to straddle the linked wire panel 13 and are bolted or otherwise secured to each other at their respective depending ends such as with a carriage bolt 40. The second pair of lower segments 38 are formed similar to the lower segments 31 of the previously described multi-bladed upright 14*a*, and thus are disposed to extend outwardly angularly upwardly with respect to the body 18.**

Figure 9:
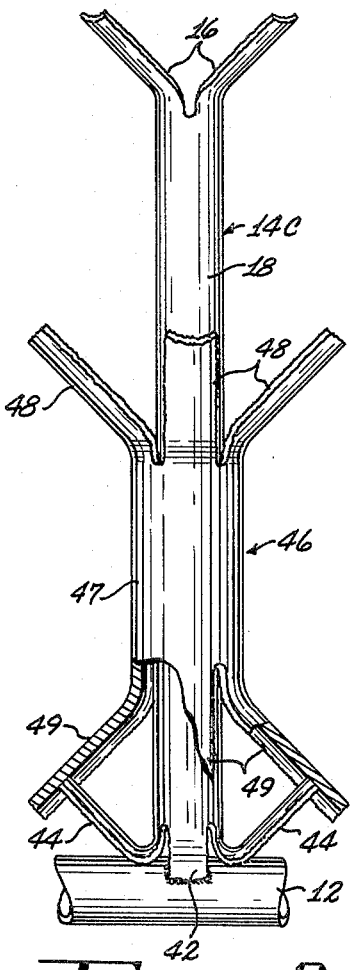
FIG. 9 is a front elevational view of another modified form of the multi-bladed upright of the present invention.

Another method of achieving additional height of the multi-bladed uprights of the present invention without sacrificing any of the security provided thereby is shown in FIG. 9. In this embodiment, a multi-bladed upright **14*c* is employed in which the body portion 18 is formed with longitudinal dimension as necessary to achieve the desired positioning of the upper knife-edged flared segments 16. The lower end of the upright 14*c* may be secured to the fence in any of the previously described manners, or by employing a modified version of the techniques previously described with reference to the uprights 14*a* and 14*b*. This modified technique shown in FIG. 9 is provided by cutting the lower end of the body 18 axially to form a first pair of diametrically opposed segments 42 (one shown) and a second pair of diametrically opposed segments 44. The first pair of lower segments 42 are positioned to straddle the top rail 12 and are welded thereto. The second pair of lower segments 44 are positioned in a manner similar to the lower segments 31 and 38 of the uprights 14***a* and 14*b*, respectively. A multi-bladed sleeve 46 is concentrically positioned on the body 18 of the upright 14*c*, and the inside diameter of the sleeve 46 is larger than the outside diameter of the body 18 of the upright 14*c* so that the sleeve 46 is free to slide longitudinally of the upright 14*c* and is also free to rotate thereabout. The sleeve 46 is formed with a body portion 47 which is axially cut from both the top and the bottom thereof to provide a plurality of upper segments 48 and a plurality of lower segments 49. The upper segments 48 are flared outwardly for positioning thereof in radially angularly upwardly disposed relationship with respect to the body 47, and the lower segments 49 are flared outwardly so as to radially angularly depend from the body 47.

Figure 10:
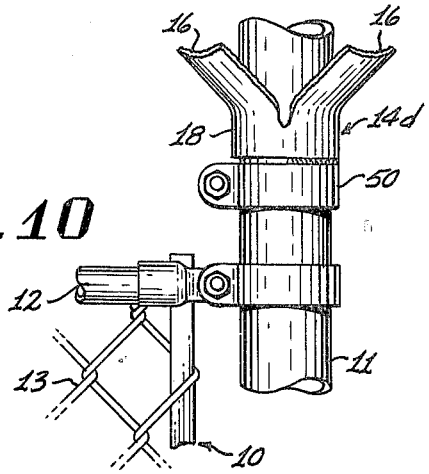
FIG. 10 is a fragmentary elevational view of a fence structure having a multi-bladed upright of the present invention mounted on a fence post thereof.

In some chain link fence installations, as shown in FIG. 10, the fence 10 will be provided with fence posts 11 (one shown) which are somewhat higher than the fence panels 13. In such instances, a multi-bladed upright 14*d* of the present invention may be employed to prevent climbing of the fence in the region of such posts. In this embodiment of the present invention, the upright 14*d* is fabricated of tubular material having an inside diameter that is larger than the outside diameter of the fence post 11 so that the upright 14*d* is coaxially mountable in circumscribing relationship on the fence post. The top of the upright 14*d* is formed with the knife-edged flared segments 16 as previously described and a clamp 50 is provided on the lower end of the body 18. The clamp is coaxial with respect to the body 18 of the upright 14*d* and may be secured thereto such as by welding.

The multi-bladed uprights 14 and the modifications 14*a*, 14*b*, 14*c*, and 14*d* of the present invention as thus far described have all been fabricated of tubing having a circular cross sectional configuration which is desirable from both functional and aesthetic standpoints when employed on a variety of fence or wall types as previously described. However, the circular tubing may be less than desirable, from an aesthetic viewpoint, when employed on specific types of fences such as a wrought iron fence or other similar types which are considered as more decorative. Therefore, FIGS. 11 through 18 illustrate other types of tubing which may be employed in fabrication of the multi-bladed upright of the present invention.

Figure 11:
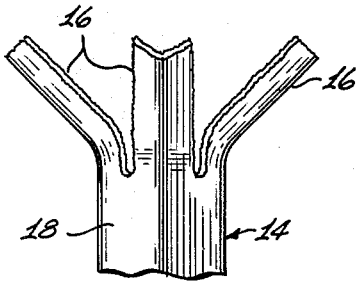
FIG. 11 is a fragmentary elevational view of the multi-bladed upright of the present invention formed of square tubing.
Figure 12:
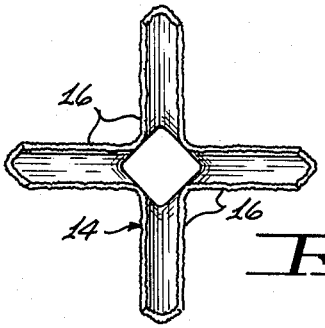
FIG. 12 is a plan view of the structure of FIG. 11.

FIGS. 11 and 12 illustrates the multi-bladed upright 14 of the present invention as being fabricated with a body 18 of square cross sectional configuration and having the plurality of knife-edge flared segments 16 formed as hereinbefore described in detail.

Figure 13:
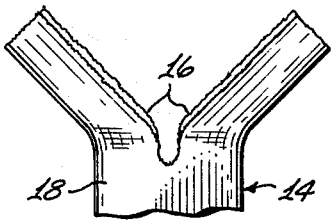
FIG. 13 is a fragmentary elevational view of the multi-bladed upright of the present invention formed of rectangular tubing.
Figure 14:
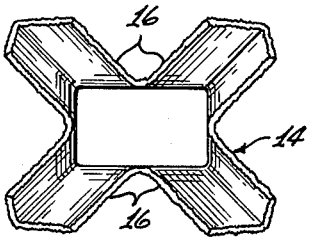
FIG. 14 is a plan view of the structure shown in FIG. 13.

FIGS. 13 and 14 illustrate a multi-bladed upright 14 as having a body 18 which is of rectangular cross sectional configuration and is provided with the plurality of knife-edge flared segments 16.

Figure 15:
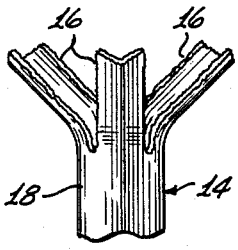
FIG. 15 is a fragmentary elevational view of the multi-bladed upright of the present invention formed of triangular tubing.
Figure 16:
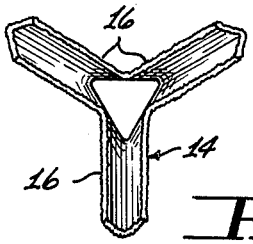
FIG. 16 is a plan view of the structure shown in FIG. 15.

FIGS. 15 and 16 show a multi-bladed upright 14 as being fabricated with a plurality of knife-edge flared segments 16 as previously described, and with a body 18 of triangular in cross sectional configuration.

Figure 17:
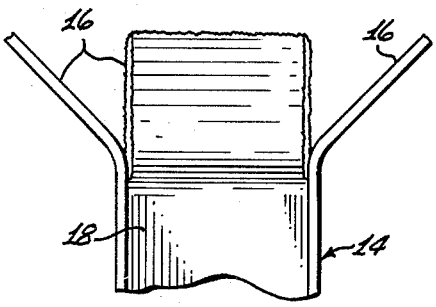
FIG. 17 is a fragmentary elevational view of the multi-bladed upright of the present invention formed of a C-shaped channel.
Figure 18:
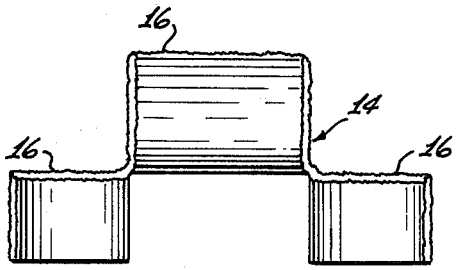
FIG. 18 is a plan view of the structure shown in FIG. 17.

FIGS. 17 and 18 illustrate the multi-bladed upright 14 as having the knife-edge flared segments 16 and a body 18 formed of a channel member having a C-shaped in cross sectional configuration.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A multi-bladed upright for use on the top of a fence structure comprising:

a. a metallic tubular body mountable adjacent the top of the fence so as to protrude upwardly therefrom;

b. a plurality of knife-edge segments at the upper end of said body, each of said segments outwardly flared with respect to said body so as to extend radially angularly upwardly therefrom; and c. a multi-bladed sleeve concentrically mounted on said tubular body, said sleeve axially slidable on said body and rotatable about the axis thereof, said sleeve having a plurality of upwardly outwardly flared knife-edge segments at the top thereof and a plurality of outwardly depending knife-edge segments at the bottom thereof.

* * * * *